United States Patent [19]

Jamieson

[11] 3,948,238

[45] Apr. 6, 1976

[54] STRESSING MECHANISM FOR A PIEZOELECTRIC IGNITION SYSTEM

[76] Inventor: Frederick T. Jamieson, 4966 4th Ave., Delta, British Columbia, Canada

[22] Filed: Oct. 7, 1974

[21] Appl. No.: 512,183

[52] U.S. Cl. ..... 123/148 BA; 310/8.7; 315/55

[51] Int. Cl.[2] ..... H01V 7/00

[58] Field of Search ..... 123/148 BA; 315/55; 310/8.7

[56] References Cited

UNITED STATES PATENTS

| | | | |
|---|---|---|---|
| 2,717,916 | 9/1955 | Harkness | 123/148 BA |
| 2,871,280 | 1/1959 | Harkness | 123/148 BA |
| 3,082,333 | 3/1963 | Hufferd et al. | 123/148 BA |
| 3,229,154 | 1/1966 | Crownover | 123/148 BA |
| 3,737,691 | 6/1973 | Hoover | 123/148 BA |

FOREIGN PATENTS OR APPLICATIONS

| | | | |
|---|---|---|---|
| 669,329 | 8/1963 | Canada | 123/148 BA |
| 670,205 | 9/1963 | Canada | 123/148 BA |

*Primary Examiner*—Wendell E. Burns
*Assistant Examiner*—James W. Cranson, Jr.
*Attorney, Agent, or Firm*—Fetherstonhaugh & Co.

[57] ABSTRACT

Mechanism is provided for activating a piezoelectric crystal used to produce a spark at a plug fitted to the cylinder of an internal combustion engine. The mechanism has a striker for delivering current-generating blows to the crystal and this striker is coaxially mounted with respect to a driven shaft of the engine such as the crank shaft or cam shaft. Cam means connects the striker to a rotor which is driven by the shaft through drive means including a one-way clutch. The striker is reciprocated in timed relation to rotation of the driven shaft and can be rotated about its own axis by a device which is operated to vary the timing of the spark in accordance with the speed of the engine.

5 Claims, 6 Drawing Figures

Fig. 1.
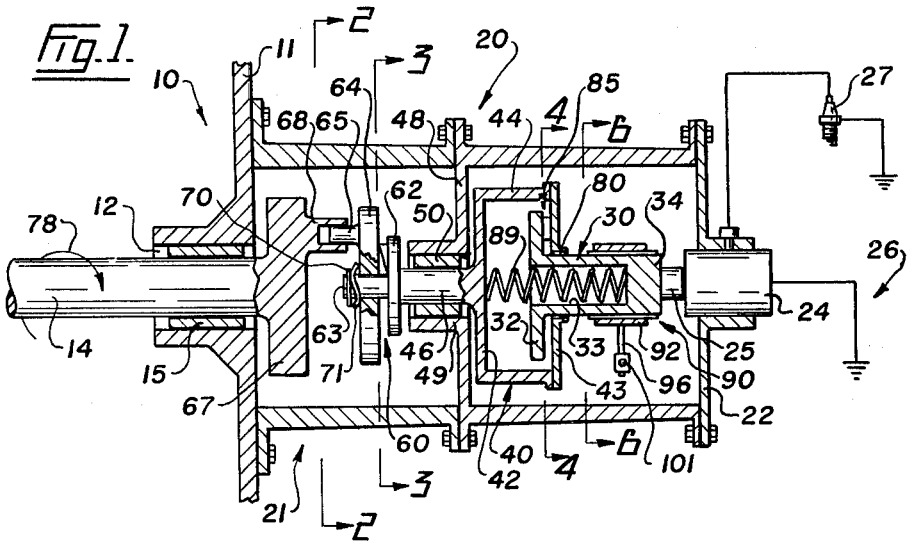
Fig. 2.
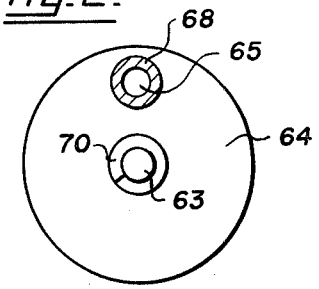
Fig. 4.
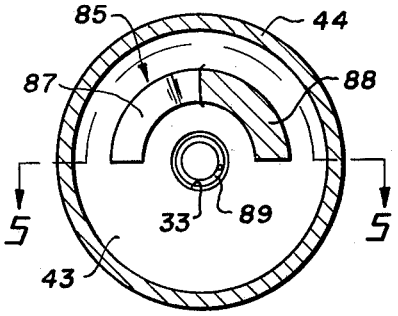
Fig. 3.
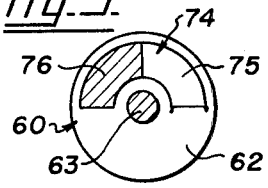
Fig. 5.
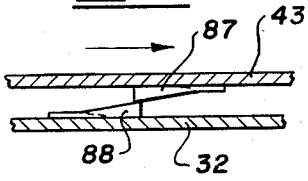
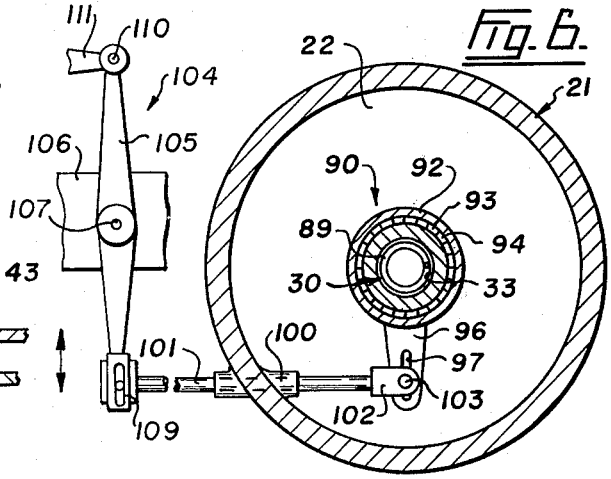
Fig. 6.

STRESSING MECHANISM FOR A PIEZOELECTRIC IGNITION SYSTEM

This invention relates generally to a piezoelectric ignition system and more particularly to a mechanism for stressing the crystal of such a system.

There are a number of ignition systems for vehicles as well as stationary motors which utilize piezoelectric elements to produce a high voltage spark at a plug. Many of these devices are mechanically sound and have proven to be satisfactory whenever weight and compactness are not considered important factors. Attempts have been made to miniaturize conventional piezoelectric ignition systems so that it is practical for them to provide the spark for some very small motors, for example, the type used to power a model airplane or the like. Such attempts have not proven to be too successful for a number of reasons.

The present invention provides a mechanism which allows a piezoelectric crystal to be stressed directly from a high-speed motor shaft whereby to provide a fuel-igniting spark at appropriate times in the engine cycle. The mechanism is simple, inexpensive as well as lightly constructed so as to be particularly well suited for use in miniature motors. A simplified timing device allows the timing of the spark to be varied according to engine speed. Finally, a safety device safeguards the mechanism in the event of the engine backfiring.

In order to achieve the above as well as other features and advantages, the present mechanism for stressing a piezoelectric crystal used in the ignition system of an internal combustion engine having a driven shaft comprises a striker movably mounted in axial alignment with the driven shaft and having a head adjacent the crystal, a rotor rotatably mounted in juxtaposition with the striker, drive means operatively connecting the rotor to the driven shaft for rotation therewith, and cam means interconnecting the striker and the rotor whereby the crystal receives current-generating blows from the head in timed relation to rotation of the driven shaft.

In drawings which illustrate a preferred embodiment of the invention,

FIG. 1 is a longitudinal section of stressing mechanism for a piezoelectric ignition system, FIGS. 2, 3 and 4 are enlarged transverse sections taken on the line 2—2, 3—3 and 4—4 respectively of FIG. 1, but with parts of a housing of the mechanism purposely omitted, FIG. 5 is a section taken on the line 5—5 of FIG. 4 but showing a striker of the mechanism in raised position, and FIG. 6 is an enlarged section taken on the line 6—6 of FIG. 1 and also showing a portion of a throttle linkage of a motor equipped with the present invention.

Referring to the drawings, the numeral 10 indicates generally a portion of an internal combustion engine the crankcase of which has an end wall 11 provided with an opening 12. The engine or motor 10 has a driven shaft 14 which may be the crank shaft in the case of a two-cycle engine, or the cam shaft in the case of a four-cycle engine. One end of the shaft 14 is shown projecting through the opening 12 wherein it is journalled by a bearing 15.

This particular engine construction has been selected to show a suitable mounting for the present stressing mechanism which is generally indicated by the numeral 20. Mechanism 20 is shown to comprise an appropriately shaped and divided housing 21 which is bolted to the end wall 11 of the crankcase with the longitudinal axis of the housing in alignment with the corresponding axis of the shaft 14. The housing 21 has an end cap 22 which carries a piezoelectric crystal 24 having an anvil 25. An electric circuit 26 connects the crystal 24 to a spark plug 27 of the engine. This crystal 24 is the well-known type which generates a high voltage current of short duration whenever the anvil 25 is struck a blow.

The required blows are delivered to the anvil 25 of the crystal by a cylindrical striker 30 which is longitudinally aligned with the shaft 14. An integral flange 32 is formed on the left end (FIG. 1) of the striker 30. Extending inwardly from the flanged end of the striker 30, is a cylindrical recess 33 which terminates near the right end of the striker, which end is shaped to provide a head 34.

The striker 30 is supported within the housing 21 by a rotor 40 which has parallel end walls 42 and 43 connected by a peripheral wall 44. Integrally formed with the wall 42, is a stub shaft 46 which is also aligned with the shaft 14. A transverse wall 48 of the housing 21 has an integrally formed sleeve 49 which is fitted with a bearing 50 and the stub shaft 46 is journalled in this bearing so that the rotor 40 is free to rotate without being able to move axially at any time.

The rotor 40 is driven from the shaft 14 by means generally indicated at 60. As shown in FIGS. 1, 2 and 3, the drive means 60 comprises an annular disc 62 which is secured to a reduced end 63 of the stub shaft 46 near the bearing 50. Slidably and rotatably mounted on the shaft end 63, is an annular plate 64 fitted with a pin 65 which projects away from said plate parallel to the longitudinal axis of the motor shaft. The shaft 14 is fitted with a flange 67 (FIG. 1 only) which carries a sleeve 68 and the pin 65 is slidably received in this sleeve. A split ring 70 is secured to the shaft end 63 to serve as an abutment for an S-shaped spring washer 71 which urges the plate 64 towards the disc 62. Drive is transmitted between the plate 64 and disc 62 by a one-way clutch generally indicated at 74 in FIG. 1. In FIG. 3, the clutch 74 will be seen to comprise interengaging driving members 75 and 76 which are provided on the opposing faces of the disc 62 and plate 64 respectively. Thus, when the shaft 14 is driven in the direction of arrow 78 of FIG. 1, the drive means 60 causes the rotor to turn in the same direction, namely, clockwise as the rotor is viewed in FIG. 4. If the shaft 14 should momentarily spin in the opposite direction, as might occur if the engine 10 were to backfire, then the one-way clutch 74 disengages so that the rotor 40 will not turn in the wrong direction with the shaft.

The striker 30 is slidably and rotatably supported by the rotor 40 and, to achieve this particular mounting, the rotor wall 43 is provided with an opening which forms a sleeve bearing 80 (FIG. 1 only) for the cylindrical striker. Flange 32 of the striker is enclosed by the hollow rotor with the striker projecting through the sleeve bearing 80 so that the head 34 normally engages the anvil 25.

The striker 30 is adapted to be reciprocated by rotation of the rotor 40 and, to transmit drive between these two parts, the mechanism 20 is provided with cam means generally indicated at 85, see FIGS. 1, 4 and 5. As shown best in FIGS. 4 and 5, the cam means 85 comprises an arcuate cam 87 formed on the inner surface of the rotor wall 43, the cam being curved about the axis of rotation of the rotor. The flange 32 of the striker is provided with a similarly curved arcuate cam 88 which is slidably engaged by the cam 87 when the rotor 40 rotates. A compression spring 89 forms part of the cam means 85, this spring serving to urge the flange 32 towards the rotor wall 43 so that the cam 88 of the non-rotating striker is traversed once by the cam 87 during each complete or 360° rotation of the rotor 40. Thus, when the rotor is turned clockwise (FIG. 2) through 360°, the cam 87, 88 and the spring 89 cooperate whereby the striker 30 is caused to reciprocate and tap the anvil 25. This single tap of the piezoelectric crystal for each revolution of the rotor stresses the crystal so as to generate a high tension current therein and it is this impulse which is delivered through the circuit 26 to produce a fuel-igniting spark at the plug 27.

The mechanism 20 is provided with timing means generally indicated at 90, see FIGS. 1 and 6. Means 90 comprises a band 92 which encircles the cylindrical striker 30 near the head 34. The striker 30 and band 92 have intermeshing splines 93 and 94, see FIG. 6, which allow the striker to reciprocate as previously described while the band remains stationary. A lever 96 depends from the band 92 and is provided with a slot 97 as shown in FIG. 6. Slidably mounted in a sleeve 100 formed in the housing 21 is a push-pull rod 101 which is fitted within the housing with a fork 102, the fork being secured to the lever 96 by a pin 103 which projects through the slot 97. The rod 101 is suitably connected to the throttle linkage of the internal combustion engine 10. Alternatively, the rod 101 may be moved in and out by means of a vacuum control unit or a centrifugal advance mechanism neither of which are shown. Thus, when the rod 101 is moved back and forth as a result of the throttle being opened and closed, the striker 30 is rotated through a short arc while still being free to reciprocate in response to the turning movement of the rotor 40.

The operation of the stressing mechanism 20 is extremely simple and, briefly, is as follows. As the engine 10 operates and the shaft 14 rotates, the drive means 60 causes the rotor 40 to spin in the same direction and at the same speed. The spinning rotor reciprocates the striker 30 due to the action of the cam means 85 including the spring 82. Each time the cam 87 rides up the cam 88, the striker head 34 is raised or lifted off the anvil 25. FIG. 5 illustrates the cam action at a time when the high points of the cam 87 and 88 are about to pass one another and when the striker has been moved inwardly of the rotor almost to the full extent. Compression spring 89 then exerts a force which causes the striker 30 to snap towards the crystal 24 when the high points of the cam pass one another and, as this occurs, the head 34 strikes the anvil 25. This blow delivered to the anvil stresses the piezoelectric crystal 24 and the resulting current flows through the circuit 26 to the plug 27 which immediately produces a spark.

The timing of the spark at the plug 27 is determined by the throttle setting of the internal combustion engine 10. As engine speed increases, the means 90 turns the striker 30 so that the cam 88 is moved towards the oncoming cam 87 and this advances the timing of the spark delivered by the plug. Conversely, as engine speed decreases, the spark is retarded.

Referring again to FIGS. 1 and 6, the timing means 90 as previously stated is operable through the throttle linkage of the motor 10. The numeral 104 in FIG. 6 indicates a portion of a typical throttle linkage which includes a lever 105 mounted on an engine part 106 by means of a pivot pin 107. One end of the lever 105 is connected as at 109 to the rod 101 and the opposite end of said lever is connected as at 110 to an arm 111 operatively secured to the throttle valve (not shown) of the motor 10. Thus, when the throttle valve is opened to provide a selected operating speed for the motor 10, the timing means 90 is actuated through the linkage 104 to adjust the engine spark to correspond to the setting of the throttle valve. If the motor speed is increased, the means 90 is moved to advance the spark. When the motor speed is decreased, the timing means 90 operates to retard the engine spark. Thus, there is provided timing means operating automatically and according to engine speed for controlling the timing of the blows delivered to the anvil 25 by the head 34. Put another way, the timing of the blows delivered to the crystal 24 by the striker 30 is varied according to rotational speed of the driven shaft 14.

Certain small motors, and particularly those which powered model airplanes and the like, have a tendency to backfire. When this occurs, however, the dog clutch 74 disengages the drive between the shaft 14 and the rotor 40 whereby said rotor is not turned in a reverse direction and damage is not inflicted to the mechanism.

From the foregoing, it will be apparent the stretching mechanism is simply constructed and can be operated directly from a rapidly turning crankshaft or cam shaft of a high speed motor without likelihood of failure and with the timing of the spark being automatic as determined by the throttle setting.

I claim:

1. Mechanism for stressing a piezoelectric crystal used in the ignition system of an internal combustion engine having a driven shaft, comprising a striker movably mounted in axial alignment with the driven shaft and having a head adjacent the crystal, a rotor rotatably mounted in juxtaposition with the striker, drive means operatively connecting the rotor to the driven shaft for rotation therewith, and cam mean interconnecting the striker and the rotor whereby the crystal receives current-generating blows from the head in timed relation to rotation of the driven shaft.

2. Mechanism as claimed in claim 1, and including timing means operating automatically and according to engine speed for controlling the timing of the blows delivered to the anvil by the head.

3. Mechanism as claimed in claim 1, in which said drive means includes a clutch adapted to disengage the rotor from the driven shaft when said shaft is rotated in a direction opposite to a normal direction of rotation.

4. Mechanism for stressing a piezoelectric crystal used in the ignition system of an internal combustion engine having a driven shaft, comprising a striker for the piezoelectric crystal mounted for reciprocatory and non-rotational movement in coaxial alignment with the driven shaft, a rotatably mounted rotor coaxially aligned with the driven shaft and the striker, drive means operatively connecting the rotor to the driven shaft, said striker having a flange, said rotor having a wall adjacent the flange, cam means between the striker flange and the rotor wall for converting rotational movement of the rotor to reciprocatory movement of the striker, and timing means operatively connecting the striker to throttle linkage of the engine whereby the timing of the blows delivered to the crystal by said striker is varied according to rotational speed of the driven shaft.

5. Mechanism as claimed in claim 4, in which said drive means includes a clutch device adapted to transmit drive between the driven shaft and the rotor only in response to rotation of said shaft in a predetermined direction.

* * * * *